United States Patent [19]

Day et al.

[11] 3,936,236

[45] Feb. 3, 1976

[54] COMPRESSOR INTAKE VALVE AND CONTROL MEANS

[75] Inventors: Richard J. Day; LeRoy Yanik, both of Owosso, Mich.

[73] Assignee: Midland-Ross Corporation, Cleveland, Ohio

[22] Filed: May 22, 1974

[21] Appl. No.: 472,112

Related U.S. Application Data

[63] Continuation of Ser. No. 296,016, Oct. 10, 1972, abandoned.

[52] U.S. Cl. ..... 417/298; 417/571

[51] Int. Cl.² ..... F04B 49/00; F04B 21/02

[58] Field of Search ..... 417/298, 571, 539

[56] References Cited

UNITED STATES PATENTS

| | | | |
|---|---|---|---|
| 1,638,114 | 8/1927 | Dunlap et al. | 417/571 X |
| 2,052,168 | 8/1936 | Crittenden et al. | 417/298 X |
| 2,092,641 | 9/1937 | Doran | 417/539 |

*Primary Examiner*—C. J. Husar
*Assistant Examiner*—Richard E. Gluck
*Attorney, Agent, or Firm*—Irvin L. Groh

[57] ABSTRACT

A compressor intake valve and control means in the form of an unloader by which the intake valve may be controlled to prevent compression of air and in which the intake valve and unloader means is disposed within the thickness of a flat compressor head. The various movable parts of the unloader and the valve are maintained in guided relationship relative to each other by the surfaces of the head itself and access to the valve portion and to the unloader portion of the assembly are independent of each other.

2 Claims, 4 Drawing Figures

COMPRESSOR INTAKE VALVE AND CONTROL MEANS

This is a continuation, of Application Ser. No. 296,016, filed Oct. 10, 1972, now abandoned.

SUMMARY OF THE INVENTION

This invention relates to air compressors and, more particularly, to an intake valve and control means therefore.

It has been the practice in connection with pumps for compressing air and particularly with compressors which are continuously driven to provide means responsive to a predetermined maximum pressure in a storage reservoir to disable the compressor from delivering additional compressed air to the reservoir. A common expedient is to provide means responsive to pressure in the storage reservoir to hold the intake valve open to the outside atmosphere or to an adjoining cylinder so that no compression of air can take place. However, such unloaders have required special attachment to the compressor and particularly when associated with the head of compressor, the attachments project to cause problems in location and mounting such as can be encountered when air compressors are used with truck air brake systems and are mounted adjacent to or on the truck engine to be driven thereby. Moreover, the separate components which are attached to the compressor create leakage problems requiring additional or special seals and careful alignment of the relatively movable parts in the unloader system and intake valve. Prior unloader arrangements and intake valves also have presented servicing problems requiring elaborate dismantling of the compressor which affects both the unloader portion and intake valve portion of the arrangement and prohibits the easy servicing of one portion separately from the other.

It is an object of the invention to provide a compressor intake valve and control means in the form of an unloader which is incorporated within the thickness of a relatively flat, removal compressor head.

Another object of the invention is to provide an intake valve and control means in the form of an unloader in which access to either the intake valve portion or the unloader portion is easily achieved independently of each other.

It also is an object of the invention to provide an intake valve and control means in the form of an unloader in which the relatively movable parts are guided for movement relative to each other within a single common part, namely, the head of the compressor.

Still another object of the invention is to provide an improved inlet valve and control means for such an inlet valve which is simple in construction and commercially feasible to manufacture and maintain.

In accordance with the present invention, an intake valve and its controlling unloader are disposed within the thickness of a relatively flat compressor head with the location of the parts determined by and guided by internal surfaces of the head itself. The intake valve portion is located adjacent one surface and the unloader portion is located adjacent the opposite surface with both portions mounted for easy removal and servicing independently of each other.

DETAILED DESCRIPTION

Figure 1:
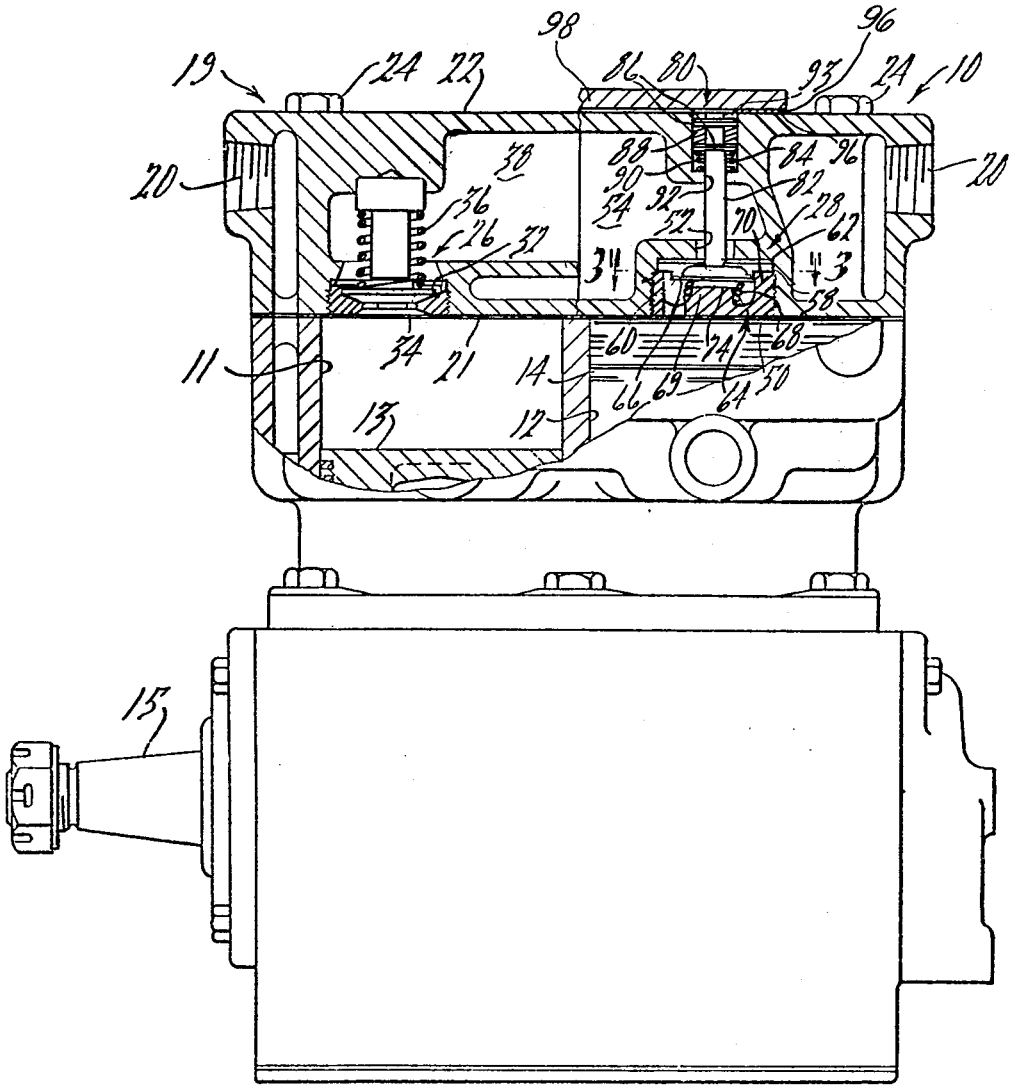
FIG. 1 is a side elevation of a compressor embodying the invention with a portion broken away and shown in section taken generally on an irregular line 1—1 in FIG. 2.

Referring to the drawings, the particularly to FIG. 1, the compressor 10 is of a two cylinder, single stage type in which a pair of identical cylinders 11 and 12 slidably support identical pistons 13 and 14, respectively. The pistons 13 and 14 are reciprocated in the cylinders 11 and 12 by means of a crankshaft 15 one end of which is indicated in FIG. 1, the upper ends of the cylinders 11 and 12 are covered by a unitary, water cooled, head assembly 19 which receives and discharges cooling water through ports 20. The head 19 has opposite, generally flat and and parallel bottom and top surfaces 21 and 22, respectively. The flat head assembly 19 is bolted to the top of the block of the compressor 10 by means of bolts 24 to cover the upper open ends of the cylinders 12 and 13.

The head assembly 19 incorporates a discharge valve generally designated at 26 and an intake valve generally designated at 28. Although the discharge valve 26 is shown associated with the cylinder 11 and the intake valve 28 is shown associated with the cylinder 12, it will be understood that each of the cylinders has both a discharge valve 26 and an intake valve 28 associated with it.

Figure 4:
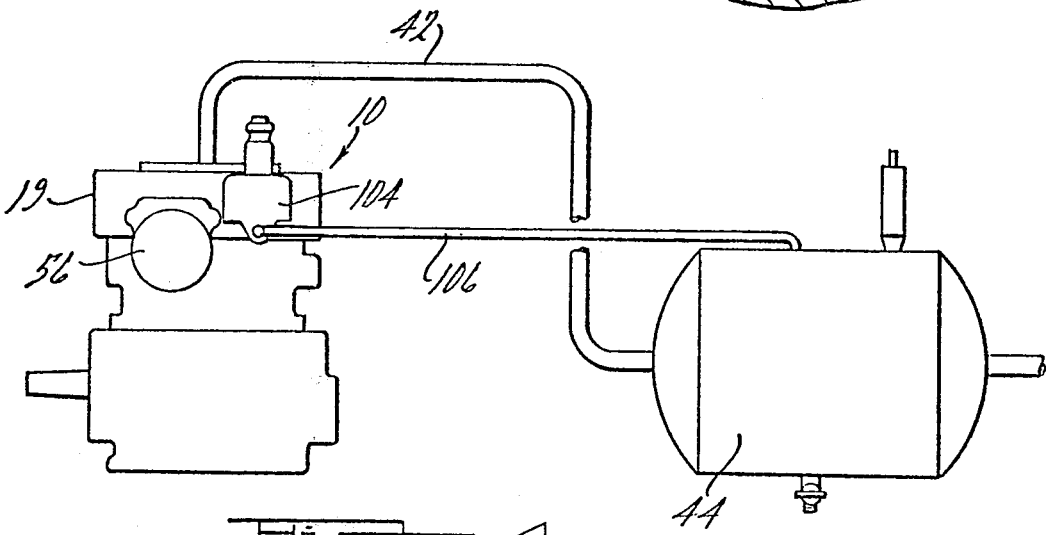
FIG. 4 is a schematic view of an air system embodying compressor utilizing the inlet valve and unloader of the present invention.

The discharge valve 26 includes a disc 32 which normally is urged into a seated relationship with an annular seat 34 by a spring 36. On the compression or upward stroke of the associated piston, the disc 32 is lifted from its seat against the biasing action of the spring 36 to admit compressed fluid to a discharge cavity 38 which communicates with an exhaust port 40 seen in FIG. 2 and which is connected by a discharge line 42 with a reservoir 44 as seen in FIG. 4.

Referring again to FIG. 1, each of the intake valves 28, one of which is associated with each of the cylinders 11 and 12, is disposed in a cylindrical cavity or bore 50 which is open to the flat bottom surface 21 of the compressor head and to the associated cylinder. The upper end of the cavity 50 is provided with a relatively large opening 52 by which the cylinders communicate with an air intake cavity 54. The intake cavity 54 is in continuous communication with an air cleaner 56, best seen in FIG. 4 and mounted on one side of the compressor 10. All air entering the compressor passes through the air cleaner 56 to the inlet cavity 54 and enters the cylinder through the opening 52 and the cavity 50.

Figure 3:
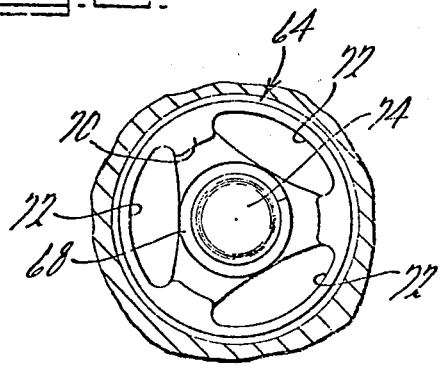
FIG. 3 is a cross-sectional view at an enlarged scale of one element of the compressor taken generally on line 3—3 in FIG. 1.

Disposed in the cavity 50 is a valve seat element 58 which has a downwardly protruding annular lip 60 forming a valve seat. The element 58 is held in position against an annular seal 62 by an inlet valve guide member 64 threaded into complementary threads in the wall of the cavity 50. A valve disc 66 is normally maintained against the lip or annular valve seat 60 by a spring 68 acting on the underside of the disc valve element 66 and having its opposite end coiled around a stop portion 69 and seated on the valve guide member 64. As best seen in FIG. 3, the space between the stop portion 69 and annular wall 70 of the guide member 64 communicates by way of three circumferentially spaced passages 72 with the associated cylinder. The central or stop portion 69 of the valve guide provides a guide to maintain the spring 68 in alignment and the top surface 74 forms a stop which limits the downward movement of the valve disc 66 away from its seat 60.

Upon downward movement of the piston 14, the pressure in the associated cylinder 12 will be decreased below atmospheric pressure and the disc intake valve element 66 will be unseated from its annular valve seat 60 against the biasing action of the light spring 68 permitting air to flow from the intake cavity 54 through the large opening 52 around the valve seat 60 and through the openings 72 to the cylinder. On the return stroke of the piston 14 in an upward direction, the pressure of the fluid in the cylinder is increased to cause a biased force along with the spring 68 which causes the disc-shaped valve element 66 to reseat on its annular seat 60. The air is compressed and discharged to the air reservoir 44 through the associated open discharge valve 26.

When the air reservoir 44, shown in FIG. 4, has received sufficient compressed air so that the pressure is at some predetermined maximum level, the compressor 10, which normally is continuously driven, must be unloaded so that further compressed air is not delivered to the reservoir.

The unloader mechanism 80 of the present invention, one of which is associated with each of the intake valves 28, includes a stem 82 in general axial alignment with the disc valve element 66, the cavity 50 and the valve guide 64. The upper end of the stem 82 is disposed in a cylindrical cavity or bore 84 which is formed adjacent to and is open to the flat top surface 22 of the compressor head 20. The upper end of the stem 82 is provided with a pair of space flanges 86 forming a groove therebetween which receives a lip type seal 88. The flanges 86 and a seal 88 form a piston in the cavity 84 which acts as a cylinder. The stem 82 is normally urged upwardly to the position shown in FIG. 1 by a spring 90 surrounding the stem 82 and having one end seated against the end wall of the cavity 84 and the other end acting against the lower flange 86 on the stem. The lower end of the stem 82 is guided by surface 92 and passes freely through an opening formed between the bore 84 and the inlet cavity 54 and also through the enlarged opening 52. As shown in FIG. 1, the lower end of the stem 82 is normally slightly spaced from the upper surface of the closed inlet valve disc 66.

Figure 2:
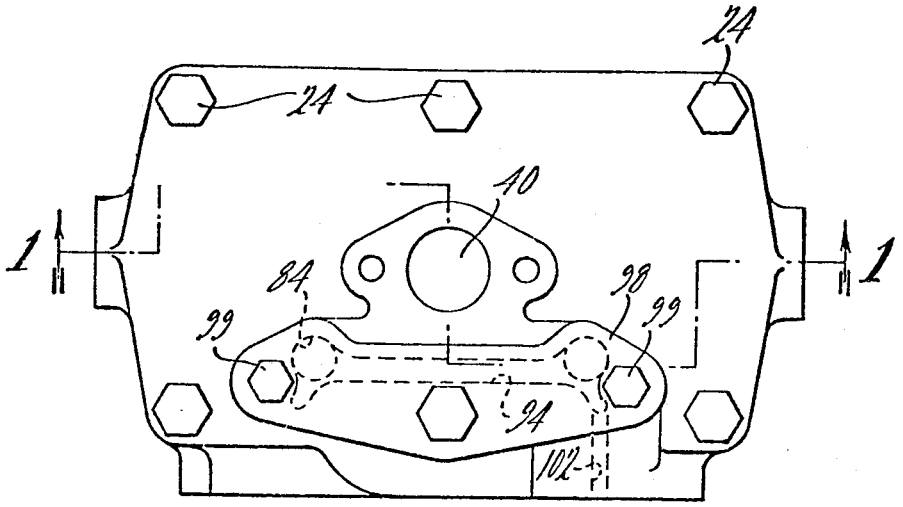
FIG. 2 is a top view of the compressor shown in FIG. 1.

The upper end of the bore 84 above the lip seal 88 forms a chamber 93 in communication with a manifold 94 which is best seen in FIG. 2. The manifold 94 is formed in a gasket member indicated in FIG. 1 at 96 which is disposed between the flat top surface 22 of the head assembly 19 and a cover plate 98 which is held in position relative to the head by bolts 99. Both of the bores 84 of the pair of unloaders associated with the pair of cylinders 11, 12 is in communication with the manifold 94 and with a laterally extending passage 102 communicating with a fluid pressure governor 104 which, as seen in FIG. 4, is mounted on one side of the compressor head 20 and communicates by way of a line 106 with the reservoir 44.

Such governors 104 are of a type well known and conventionally used in the art and include an enclosed valve which prevents the delivery of air to the manifold 94 from the reservoir 44 until some predetermined maximum pressure is established in the reservoir. For example, if it is desired to maintain a maximum pressure of 125 psi in the reservoir 44, the governor valve remains closed until such pressure is attained at which time, a pressure responsive means in the governor 104 opens the normally closed valve of the governor and admits fluid to the manifold 94 leading to the bores 84 seen in FIG. 2. Upon receiving the maximum pressure in the manifold 94, the pressure acts on the lip seal 88 to urge the stem 82 downwardly against the biasing action of the spring 90 so that the bottom end of the stem 82 engages the disc shaped valve element 66 and moves it downwardly against the biasing action of the spring 68, out of engagement with the annular valve seat 60 and into engagement with the stop 74 formed on the valve guide 64. The intake valve 60, 66 will be retained in its open position during continued reciprocation of the pistons 12 and 13 so that additional air cannot be compressed and delivered to the reservoir. The inlet valve 60, 66 will be retained in its open position until the pressure in the reservoir 44 drops to some predetermined value, for example, 105 psi at which time, the governor valve is actuated in response to that pressure level to close the governor valve and, at the same time, exhaust the air from the manifold 94. This permits the spring 90 in the cavity 84 to urge the valve stem 82 upwardly to the position in which it is shown in FIG. 1 so that the intake valve 60, 66 is free to function and permits the compressor 10 to again operate in a normal pressure delivering cycle.

Access to the unloaders 80 is readily attained by removing the cover plate 98 which makes the unloaders 80 readily removable as a unit from the cavity 84 without interfering in any way with the intake valve 28 and without requiring removal of other parts of the compressor. In like manner, the intake valves 28 are recessed in the cavity 50 in the bottom portion of the head 19 so that if servicing is required, the head may be removed from the remainder of the compressor without disturbing the unloaders 80 or associated parts. Upon removal of the head, the valve guide 64 may be unscrewed from the cavity 50 to give access to the various components for servicing.

It will be noted that the unloader 80 and the intake valve 28 associated therewith are both disposed within the thickness of the water cooled head 20 and that the various surfaces which guide the relatively movable unloader and intake valve parts are formed by the same part, namely the head 19, and no special provisions for alignment of the unloader 80 relative to the valve intake assembly 28 are required.

It will now be seen that there has been provided an inlet valve and unloader assembly which is disposed within the thickness of a head of an air compressor and that the various components are easily accessible for repair and replacement when required. Moreover, the disposition of the components is such that special bearings and seals are not required to assure alignment for proper operation.

What is claimed is:

1. In a reciprocating compressor having a body portion forming a pair of cylinders, a removable unitary head having a flat bottom surface covering the open ends of said cylinders, said head having a flat top surface parallel to said bottom surface, a pair of first cylindrical chambers formed in said unitary head and opening to said bottom surface and said pair of cyclinders, respectively, a pair of second cylindrical chambers axially aligned with said pair of first cylindrical chambers, respectively, and opening to said top surface of said head, an intake chamber formed in said head and communicating with said pair of first chambers, a plate removably connected to said top surface of said head and closing said pair of second chambers, inlet valve means removably disposed in each of said first chambers and being disposed between said cylinders and said intake chamber, means formed by said plate and connecting said pair of second chambers to each other and to a source of fluid pressure, and plunger means removably disposed in each of said second chambers and within said unitary head and including pressure responsive portions simultaneously responsive to pressure in said second chambers, said plunger means including portions projecting from said second chambers into said first chambers and being movable toward said inlet valve means to hold the latter simultaneously open in response to a predetermined pressure in said source, said inlet valve means being separately removable independently of said plunger means upon removal of said removable head and said plunger means being separately removable independently of said valve means upon removal of said plate.

2. The combination set forth in claim 1 in which said means connecting said pair of second chambers to each other and to said source is disposed between said flat top surface of said head and said plate.

* * * * *